US005934060A

United States Patent [19]

Schmitz

[11] Patent Number: 5,934,060

[45] Date of Patent: Aug. 10, 1999

[54] METHOD FOR REGULATING THE VACUUM IN A SUCTION AIR INSTALLATION OF A TEXTILE MACHINE

[75] Inventor: Wilhelm Schmitz, Mönchengladbach, Germany

[73] Assignee: W. Schlafhorst AG & Co., Moenchengladbach, Germany

[21] Appl. No.: 08/994,695

[22] Filed: Dec. 19, 1997

[30] Foreign Application Priority Data

Dec. 20, 1996 [DE] Germany ..... 196-53-617

[51] Int. Cl.[6] ..... D01H 11/00

[52] U.S. Cl. ..... 57/304; 57/264; 57/305; 15/319

[58] Field of Search ..... 57/304, 264, 300, 57/305; 15/301, 319

[56] References Cited

U.S. PATENT DOCUMENTS

| | | | |
|---|---|---|---|
| 5,154,045 | 10/1992 | Saruwatari et al. | 57/304 |
| 5,161,111 | 11/1992 | Oehler et al. | 57/264 |
| 5,216,777 | 6/1993 | Moro et al. | 15/319 |
| 5,251,358 | 10/1993 | Moro et al. | 15/319 |

FOREIGN PATENT DOCUMENTS

| | | |
|---|---|---|
| 0 212 978 A2 | 8/1986 | European Pat. Off. . |
| 31 18 221 A1 | 3/1982 | Germany . |
| 36 11 824 A1 | 11/1986 | Germany . |
| 38 23 289 A1 | 1/1989 | Germany . |
| 40 26 574 A1 | 2/1991 | Germany . |
| 41 03 718 A1 | 8/1991 | Germany . |
| 40 09 878 A1 | 10/1991 | Germany . |
| 43 00 586 A1 | 7/1994 | Germany . |
| 43 41 732 A1 | 6/1995 | Germany . |
| 44 46 379 A1 | 6/1996 | Germany . |
| 195 11 960 A1 | 10/1996 | Germany . |
| 58-74463 | 5/1983 | Japan . |

*Primary Examiner*—William Stryjewski
*Attorney, Agent, or Firm*—Kennedy Covington Lobdell & Hickman, LLP

[57] ABSTRACT

For the optimization of the vacuum output of a suction air installation of a textile machine, the vacuum output is adjustably regulated by initially starting a batch with a predetermined vacuum for the vacuum demands under basic operating conditions and additional fluctuating working conditions, counting the errors which cannot be rectified and the attempts to rectify the errors caused by insufficient vacuum during a predetermined time period, subsequently changing the vacuum output of the suction unit during a subsequent time period, comparing the number of errors occurring under the changed vacuum conditions with the number which had occurred in the previous time period, and increasing the vacuum output when the number of errors exceeds a maximum predetermined amount of errors and decreasing the vacuum output when the number of errors is at or less than the maximum predetermined amount of errors.

24 Claims, 4 Drawing Sheets

METHOD FOR REGULATING THE VACUUM IN A SUCTION AIR INSTALLATION OF A TEXTILE MACHINE

FIELD OF THE INVENTION

The present invention relates generally to a method for regulating the vacuum in a suction air installation, and more particularly to such a method wherein a suction unit at a textile machine having a plurality of work stations which utilize suction air is operated such that, in response to the suction air requirements of the work stations, the vacuum is not permitted to drop below a minimum level necessary to satisfy basic demands and a regulating device is provided for increasing the suction output of the suction unit by a predeterminable amount when increased suction air demands occur.

BACKGROUND OF THE INVENTION

Suction air is required for a multitude of work processes in textile machines. For example, in spinning machines the yarn end is detached by means of suction air from the winding bobbin after a yarn break and is pneumatically prepared for piecing. In winding machines, which have a plurality of winding stations arranged next to each other, a catch nozzle is disposed in the yarn path at each winding station in order to aspirate and hold the leading yarn end of the lower feed yarn, so that no drum winding occurs. Continuously applied suction air in the vicinity of the unwinding bobbin is used to aspirate off dirt, flying dust and fibers being created when the yarn is unwound from the bobbin. Since suction air is always needed for these purposes, the vacuum needed for these purposes is considered the basic or minimum demand for vacuum of the winding machine. Occurrences which produce an increased suction air demand and therefore an increased vacuum requirement are the aspiration of the yarn end prior to piecing the yarn.

As a rule, a suction output is made available for the basic demands or for the work demands, which provides a vacuum which in each case is considered to be optimal on the basis of experimental values. Whether the vacuum provided is actually optimal can only be checked if there is a possibility of making comparisons. It is possible that an initially set vacuum can be reduced without the quality of the yarn suffering or without an increase in defects or a reduction of the efficiency of the machine. On the other hand, it is also possible that the initially set vacuum is not optimal and that the number of occurring errors can be reduced by raising it to a higher level. Thus, an increase in the vacuum results in a further reduction of the absolute pressure, and reducing the vacuum results in an increase of the absolute pressure.

It is known from German Patent Publications DE 44 46 379 A1 and DE 195 11 960 A1 to first set a vacuum at a textile machine, by means of which the basic demands for a vacuum at a textile machine can be met. If the above-mentioned occurrences arise, the vacuum is initially raised to a corresponding level to assure that the occurrences causing an increased vacuum demand can be addressed, while the basic demands of the machine are satisfied at the same time.

From German Patent Publication DE 195 11 960 A1 it is furthermore known to check the quality of the work performed in connection with the processing of occurrences which create a vacuum demand and, in case of deviations from a predetermined tolerance range, to immediately adapt a predeterminable increased vacuum accordingly. This procedure requires an immediate checking of the results of work operations following the occurrence. A resultant correction takes place in relation to the respective occurrence. This results in continuous fluctuations of the vacuum changes provided per occurrence, which are work station-dependent. A transfer to other work stations will possibly result in additional errors.

OBJECT AND SUMMARY OF THE INVENTION

It is accordingly an object of the instant invention to improve the vacuum supply in a textile machine in respect to energy requirements and success in a batch-related manner.

This object is attained by a novel method for regulating the vacuum in a suction air installation comprising a suction unit at a textile machine with a plurality of work stations which make various demands on suction air. Under the method, the vacuum output of the suction unit is basically regulated to prevent the vacuum output from dropping below a basic level which satisfies basic machine demands and to increase the vacuum output by a predeterminable amount in response to work occurrences of the machine which impose additional vacuum demands. More specifically, the regulating process comprises optimizing the vacuum output for a new textile batch by starting the batch with a predetermined vacuum setting for the basic and work demand and, during a first predetermined time period in the course of the batch, counting the errors which cannot be rectified and the attempts to rectify errors caused by insufficient vacuum. In a subsequent time period in the course of the batch, the vacuum output of the suction is changed and errors which cannot be rectified and the attempts to rectify errors caused by insufficient vacuum are counted and compared with the number of errors counted in the first time period. The vacuum output is increased if the counted errors exceed a maximum predetermined amount of errors and decreased if the amount is counted errors are less than the maximum predetermined amount of errors.

The invention thereby allows an automatic optimization of the suction output of a suction unit of a textile machine in relation to a batch by means of the automatic change of a vacuum initially set at the start of the batch, a subsequent evaluation of the effect on the number of the errors which have respectively occurred and, as a function of the result of the evaluation, an actuation or further change of the vacuum.

Energy can be saved by reducing the suction output. On the other hand, a reduction of the suction output as a function of the vacuum level and the specific conditions of the respective batch lead to an increase in errors. Therefore the reduction of the suction output can only be implemented to the extent that the efficiency of the machine does not drop significantly. Therefore the number of errors occurring in respect to the error tendency constitute the criteria which determine whether and to what extent the vacuum can be reduced. The lowest possible vacuum with a tolerable number of errors is sought. The determination of the priority of the two characteristics is made by the operator of the machine.

At the start of a batch, the suction output of the suction unit is set such that a predetermined vacuum value is attained. It is possible to preset a vacuum for the basic demand and a further, higher vacuum for the additional work demands which are expected. Drum windings are one of the errors occurring when there is insufficient vacuum for the basic demands. Drum windings are among the errors which a machine cannot repair on its own and which therefore require the intervention of an operator. Repeated regulating attempts in the course of compressed air-assisted error removal is also considered to be an error if, because of an insufficient vacuum for the prevailing work demand, it is required in the course of suctioning the yarn end off the winding bobbin and of retrieving the bottom yarn from the cop to make attempts for correcting the error. If more than a predetermined number of these attempts fail, the errors having occurred can also not be automatically fixed, because the respective work station is stopped, so that the error can also be corrected by an operator.

If experimental values are available regarding the possible number of errors occurring on the average within a defined time period during the batch run, this number can be used as a measurement for a comparable time period following the batch start.

The decision as to how the suction output needs to be changed, i.e. whether the vacuum must be increased for the respective demand or whether it can be reduced, is made on the basis of the comparison of the number of errors having occurred at a defined suction air demand with the predetermined threshold value. The change in the vacuum takes place in stages by a respectively predetermined amount, for example by 2 mbar increments. The change of the vacuum takes place by an appropriate setting of the suction output of the suction unit, as a rule by an appropriate change of the rpm of the drive motor of the suction unit.

To make a systematic comparison of the error frequency during each new change of the vacuum possible, the periods of time in which the effects of the change are checked are identical. In connection with winding machines, for example, the running time of the cops can be used for determining the size of the time periods. With coarse yarn, changes of the cops are more frequent, and therefore the possibilities of errors occurring during a cop change, in particular when retrieving the top yarn, are greater than with longer-running cops, for example with a finer yarn.

If in the course of an initial reduction of the vacuum in connection with a prevailing demand, in particular when starting a batch for which no experimental values are available, it is shown that the error difference lies above a tolerable threshold, it is advantageous if the vacuum is raised directly above the set initial pressure. Thereafter, the number of errors is again counted during a comparable ensuing length of time. If the number of errors clearly falls in comparison with the number of errors during the first time period following the start of the batch, an increase in the vacuum by a further defined amount and a renewed check is possible. The vacuum is reduced to the vacuum set at the start of the batch only if an increase of the vacuum does not result in a significant improvement regarding the number of occurring errors.

If a batch is started for which no experimental values are as yet available, the number of errors occurring during a fixed time period following the batch start is used as a comparison value for the number of errors in the following time period. In the subsequent time period the vacuum is reduced. The number of errors then occurring determines whether the vacuum can be reduced further or whether it must be raised above the initially set level. If a comparison of the number of errors occurring in the subsequent time period with the number of errors which have occurred in the previous time period shows that the error difference has fallen below the maximum preset difference, the next lower suction output can be selected. If the error comparison shows that the error difference has exceeded the preset error difference, the suction output is raised at least to the previous level.

If, following the reduction of the vacuum for a defined demand, so many errors occur that a threshold value is exceeded even prior to the end of the time period, the vacuum is again raised to the previous level. In this way, an unnecessary drop of the efficiency of the machine is advantageously prevented.

Events can occur in the course of making a batch which lead to increased regulating errors, without the reason being an erroneously set vacuum. Increased regulating errors can occur, for example, in connection with faulty yarn. In order to make the determination of the optimal vacuum independent of such events, it is advantageous to perform the change of the vacuum from the initial level in stages at least one more time. In this manner, the vacuum value which had initially been considered to be optimal for a defined demand is verified or must be corrected.

The lowest value of a vacuum in relation to the respective demand determined during a given time period is stored in relation to the batch in a computer, controller or other regulating device of the textile machine if during this time period the threshold value for the errors is not exceeded. To make sure of the result, it is possible to check the determined optimal value of the vacuum in at least one further time period. Storage of the optimal vacuum value for a given prevailing demand takes place automatically and independently of the observation of an operator.

It is possible in case of each fresh start of a comparable batch to set the stored optimal value of a vacuum for a defined work demand for the batch automatically as the predetermined value of the vacuum. Therefore, presetting by an operator is not necessary.

As a rule, there is a predetermined fixed relationship between the vacuum for the basic demand and the vacuum for the work demand. When predetermining the vacuum for the basic demand, the vacuum for the work demand is set as a predetermined percentage increase of the basic demand. During a change of the vacuum value for the basic demand, a proportional change in the same direction takes place for the work demand. However, the change of the vacuum for the work demand and the change of the vacuum for the basic demand can also take place independently of each other. In the course of changing the vacuum for the one demand, the vacuum of the other demand remains on the same level.

The invention will be explained hereinafter in more detail in relation to a preferred embodiment by means of flow charts of occurrence, pressure and time.

DETAILED DESCRIPTION OF THE PREFERRED EMBODIMENTS

Figure 1:
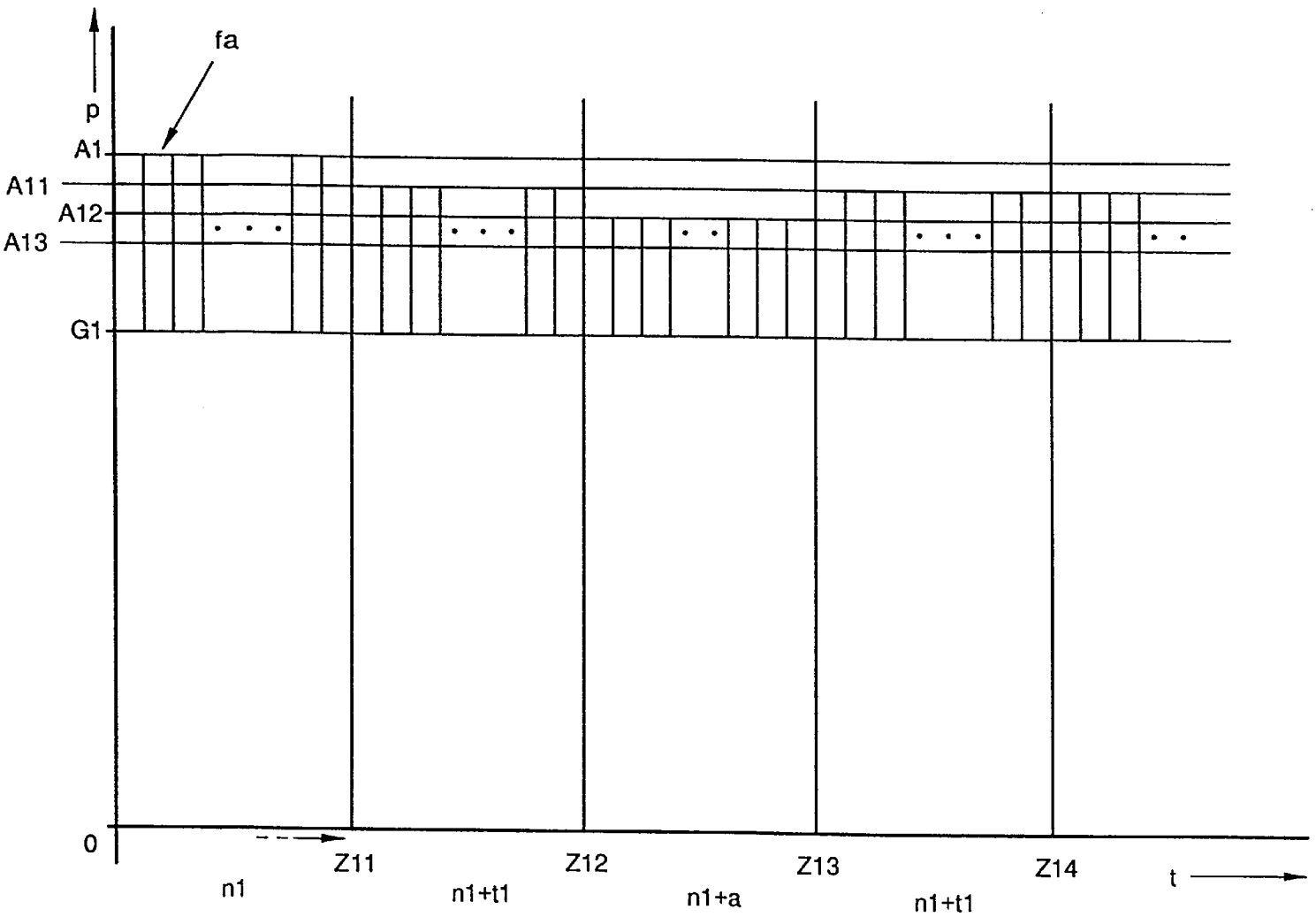
FIG. 1 is a pressure flow chart representing the vacuum reduction for the work demand in stages, in accordance with the present invention.

Referring now to the accompanying drawings and initially to FIG. 1, a diagram (not to scale) representing the pressure-time relationship of a winding machine is provided wherein the prevailing vacuum p applied to the machine by its suction supply has been plotted over the time t. A constant vacuum G1 is applied to provide for the basic demand of this winding machine, i.e., the vacuum which is continuously applied to the catch nozzles in the yarn path, among others. In the present case this vacuum is not intended to be changed.

A vacuum A1 for the work demand, which is greater than the basic demand, has furthermore been depicted to represent the vacuum which is needed for retrieving the upper yarn end trailing from the winding bobbin and to aspirate the bottom leading yarn end from the cop. While the basic demand lies at 45 mbar, for example, the vacuum A1 for the work demand lies at 60 mbar. To detect a batch-related optimal vacuum for the work demand, the batch is started at the time zero at the set vacuum A1.

It is intended to reduce the vacuum for the work demand by the same amount in stages during the running time of the batch. The reduction, represented in an exaggerated way in the present exemplary embodiment, is intended to be 2 mbar, for example. Three stages A11, A12 and A13 representing the reduction of the vacuum have been drawn in the diagram.

Time periods Z11, Z12, Z13 and Z14 of equal length have been plotted on the time axis. These are the identical periods of time in which the number of the errors which occur is respectively counted.

At the start of the batch, the full vacuum A1, not yet reduced for the work demand, is applied over the period of time Z11 at each respective work station when an occurrence is processed. During each processing of an occurrence, i.e., an error fa, the vacuum is increased from the basic demand G1 to the vacuum A1 as indicated by the dashes fa symbolizing the error. Therefore each dash represents an error which has occurred.

In connection with batches wherein experimental values regarding the possible number of occurring error are available, these experimental values are made the basis as standard values. Already during the first time period Z11 after the batch start, the number of occurring errors, n1 here, should not exceed a predetermined standard value. Since these errors are accidental errors it is possible to tolerate a small additional number of errors, here t1, during the comparison with the standard value. If the number of errors after the first time period already exceeds the threshold value, n1+t1 here, the vacuum is not reduced, instead a check is made by increasing the level to determine whether the previously set vacuum was even advantageous.

If no experimental values are as yet available, for example when starting an unknown batch, the errors which have occurred in the first time period, Z11 here, are made the basis for the standard value in the subsequent time periods. When reducing the vacuum in the subsequent time periods, the number of errors which occurred in the first time period should not be exceeded, if possible, although it can be provided hereagain to tolerate a deviation from the standard value by a small number of additional errors.

The number of errors occurring in the first time period Z11 at the set level of the vacuum A1 for work demands is n1. This number n1 of errors is fixed as the standard value. In the course of the subsequent reductions of the vacuum for the work demand, the number of errors, i.e. the number of errors in the first time period Z11 increased by a tolerable number t1, should not be exceeded in the subsequent time periods. Since these errors are accidental errors, an additional number of errors t1 is tolerated over the number of errors occurring in the time period Z11.

A reduction of the vacuum for the work demand to the vacuum level A11 takes place at the end of the first time period Z11. At the end of the time period Z12, the number n1 of the errors compared with the previous time period Z11 has increased, but still lies within the tolerable number n1+t1. Since the number of errors which have occurred lies within the predetermined amount, at the end of the time period Z12 another reduction by the predetermined amount takes place to the vacuum A12.

At the end of the time period Z13 the number of errors n1 which had occurred in the first time period Z1 has been exceeded by a number a, which cannot be tolerated. Therefore the last reduction in vacuum from A11 to A12 did not lead to an advantageous result and must therefore be canceled.

Figure 3:
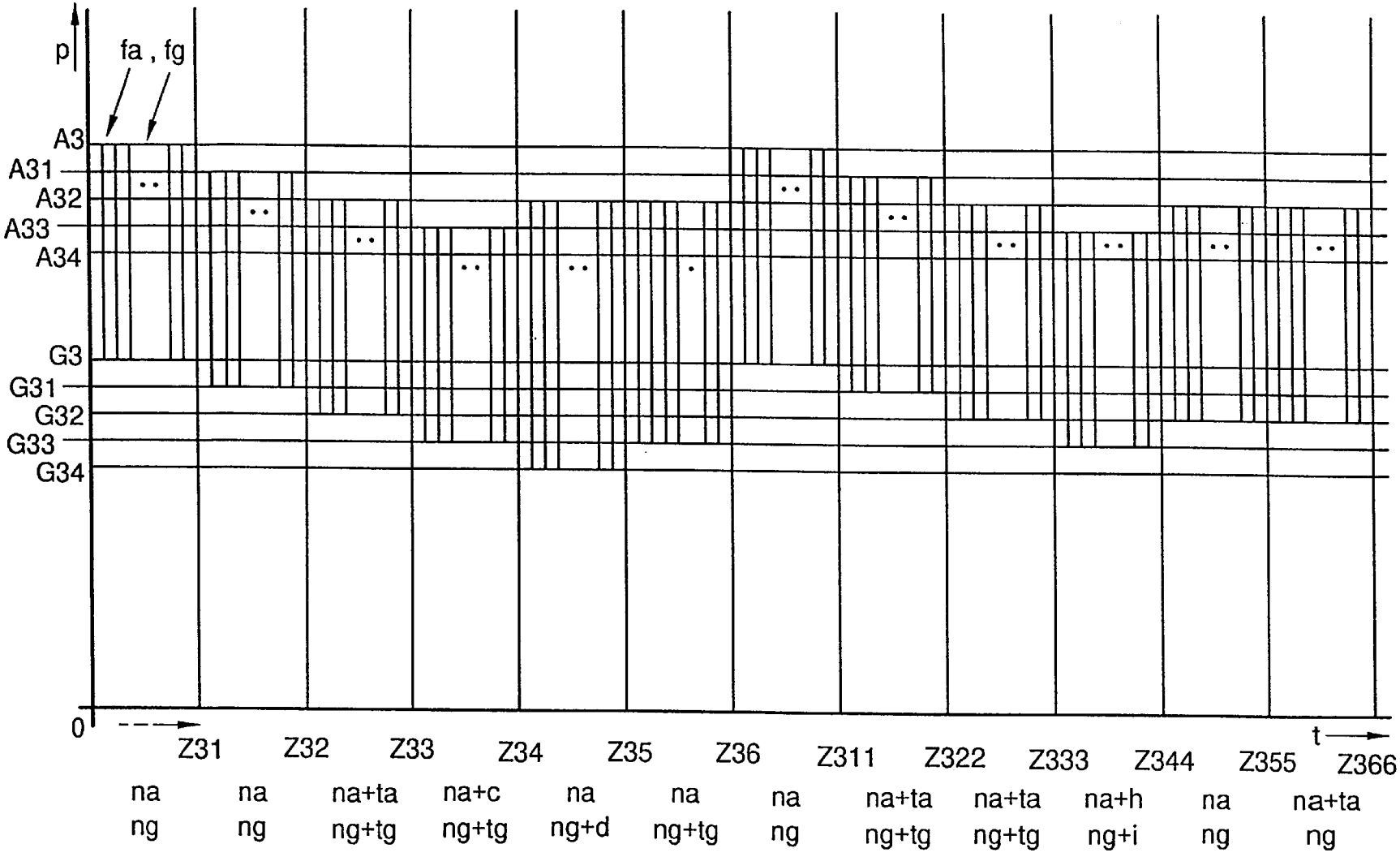
FIG. 3 is a pressure-time flow chart representing the simultaneous reduction of the vacuum for the work demand and the vacuum for the basic demand with a repetition of the vacuum reduction in stages, in accordance with the present invention.

Thus, instead of further reducing the vacuum for the work demand to the value A13 in the next time period Z14, it is increased to return to the vacuum A11 which had been set in the previous time period Z12. The frequency of occurring errors can be checked during the time period Z14 and, if desired, again in the next following time period, before the determined vacuum A11 is finally stored in the regulating device of the textile machine as the optimal, batch-related vacuum for the work demand. At the end of the time period Z14 a check reveals that the number of errors lies in the tolerable range n1+t1. Therefore the automatically determined vacuum A11 can be stored as the optimal, batch-related vacuum for the work demand of the textile machine. During processing of the batch this vacuum remains set, unless the steps of repeated reduction represented in FIG. 3 are taken.

Figure 2:
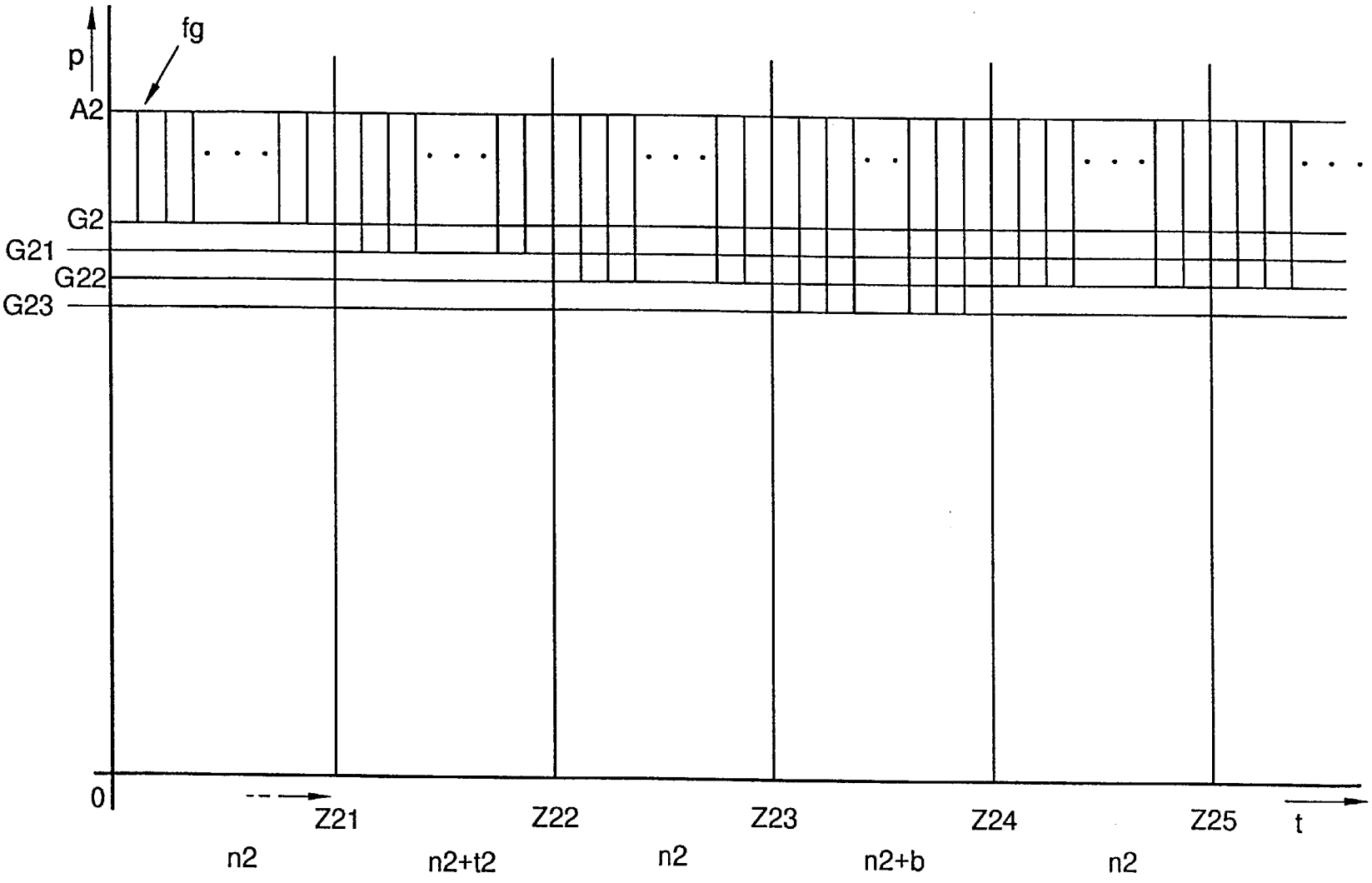
FIG. 2 is a similar pressure flow chart representing the vacuum reduction for the basic demand in stages, in accordance with the present invention.

A diagram is represented in FIG. 2, also not to scale, in which a reduction in stages of the vacuum for the basic demands of the machine is shown. Hereagain, time periods of equal length have been plotted on the time axis.

In the instant case, the vacuum A2 for the work demand remains constant. Starting with the vacuum G2 for the basic demand, it is intended to reduce the vacuum for the basic demand in equal stages from G2 through G21 and G22 to G23. During the first time interval Z21, the number of errors fg which have occurred is counted, as known from the previous exemplary embodiment. The number n2 is fixed as the standard value for the number of errors which, increased by a tolerable number t2, may not be exceeded in the subsequent time periods. Hereagain, dashes symbolize the increase of the vacuum and thereby simultaneously indicate the number of errors which have occurred.

At the end of the first time period Z21, the vacuum of the basic demand is reduced from the value G2 to the value G21 at the start of the time period Z22. At the end of the time period Z22 the number of errors which have occurred has been increased by a tolerable number t2 in respect to the errors n2 in the first time period Z21. Since the predetermined threshold value has not been exceeded, a reduction of the vacuum for the basic demand to the value G22 takes place at the start of the next time period Z23. At the end of the time period Z23 the number of errors has actually dropped slightly compared with the previous time period and approximately lies at the number n2. Thereupon the vacuum for the basic demand is reduced to the next lower stage G23. However, at the end of the time period Z24, the number of errors which have occurred has increased to such an extent that the number n2+b lies above the tolerable number of errors. Therefore the vacuum for the basic demand is again increased to the stage G22 which was previously in effect during the time period Z23.

In the following time period Z25 a check is made whether the number of occurring errors in connection with the vacuum G22 for the basic demand does not exceed the threshold value. Since the number of errors of n2 is the same as in the time period Z23, the vacuum value which has now been set can be considered as the optimal basic demand vacuum for the batch and can be stored. As can be further seen from the diagram, it remains set until the end of the batch.

An exemplary embodiment is shown in FIG. 3 in which both the vacuum for the work demand and the vacuum for the basic demand are reduced. The reduction takes place simultaneously and in each case in stages of the same size. This diagram is also merely a schematic representation.

The vacuum A3 for the work demand and the vacuum G3 for the basic demand have been set at the time zero at the start of the batch. The number of errors which have occurred is determined at the end of the predetermined time period Z31. In the process, a differentiation is made between errors fa, which have arisen because of occurrences wherein the vacuum of the work demand has to be increased for their correction, and errors fg, which occur in connection with the basic demand at the prevailing vacuum, in particular drum windings. The number of the occurring errors must be appropriately broken down and those related to the vacuum for the work demand are represented as na, and those for the basic demand are represented as ng.

At the start of the time period Z32, the vacuum for the work demand is reduced to the level A31 and the vacuum for the basic demand to the level G31. Since during this time period the number of occurring errors remains the same both in respect to the basic demand and in respect to the work demand, a further reduction of the vacuum for the basic demand to the level G32 and of the vacuum for the work demand to the level A32 takes place at the end of the time period Z32. During the time period Z33, the number of occurring errors respectively increases by a tolerable number ta or tg.

For this reason, a further decrease of the vacuum for the basic demand to the level G33 and for the work demand to the level A33 respectively takes place in the subsequent time period Z34. At the end of this time period, the number of errors in respect to the vacuum for the work demand has risen by the number c in comparison with the number of errors at the end of the time period Z31, which means that the threshold value was exceeded. The decrease of the vacuum for the basic demand to the level G33 does not result in an increase of the number of errors.

For this reason, the reduction of the vacuum for the work demand is reversed at the start of the time period Z35 and the vacuum for the work demand is again raised to the level A32. But the vacuum for the basic demand is further decreased to the level G34. At the end of the time period Z35, an evaluation of the errors shows that following the increase of the vacuum for the work demand to A32 the number of errors has decreased to na, while the errors occurring after the reduction of the vacuum for the basic demand have unduly risen by the number d and therefore lie above the threshold value. For this reason, the reduction of the vacuum for the basic demand is reversed in the subsequent time period Z36 and the vacuum is again raised to the level G33. At the end of the time period Z36, it becomes apparent that the number of errors which occurred after the increase of the vacuum was again reversed and lies below the threshold value.

The vacuum for the basic demand G33 as well as the vacuum A32 for the work demand now determined can respectively be classified as the optimal batch-related vacuum.

In order to make the determination of the optimal vacuum independent of accidental occurrences, for example the feeding of the wrong yarn, as already mentioned, the determination of the optimal vacuum can be repeated once more. To this end, the vacuum for the basic demand and the vacuum for the work demand are again increased to the initial levels G3 and A3 respectively, at the start of the time period Z311. The time period Z311 is of the same length as the time period Z31. Again, the respective errors caused by the reduction of the vacuum for the basic demand or the reduction of the vacuum for the work demand are determined. If the number of the occurring errors now considerably differs from the number of errors which occurred in the time period Z31, the vacuum of the respective demand is not decreased and another check at the same level is made instead.

In the instant exemplary embodiment, the number of errors in the time period Z311 has not increased in comparison to the number of errors in the time period Z31, so that in the subsequent time period Z322 the reduction of the vacuum for the basic demand to the level G31, as well as the reduction of the vacuum for the work demand to the level A31, take place.

As can be seen from the diagram, the number of errors remains below the threshold value, so that in the subsequent time period Z333 a further reduction of the two vacuums is performed. The vacuum for the basic demand is reduced to the level G32, and the vacuum for the work demand to the level A32. The number of errors after this reduction also does not exceed the threshold value, so that at the start of the time period Z344 the vacuums are again reduced by one stage, i.e., the vacuum for the basic demand is reduced to the level G33 and the vacuum for the work demand to the level A33.

At the end of the time period Z344 the number of errors ng+i in relation to the vacuum of the basic demand, as well as the number of errors na+h in relation to the vacuum of the work demand, have increased to such an extent that it is necessary to reverse the respective reduction of the vacuum. Therefore, in the subsequent time period Z355 the vacuum for the work demand has again been raised to the level A32, and the vacuum for the basic demand to the level G32. At the end of the time period Z355, the number of errors occurring in the time period Z366 is again compared with the number of errors in the previous time period. In this case, the errors which have occurred after the reduction of the vacuum for the basic demand as well as after the reduction of the vacuum for the work demand lie below the threshold value.

Therefore, in the second cycle of reductions, the vacuum for the work demand lies again at the level A32, which had already been determined to be the optimal vacuum in the first cycle. However, there is a difference in regard to the vacuum level G32, which had previously been determined to be optimal for the basic demand. Because of this difference with the previous vacuum value for the basic demand which had been determined to be optimal, the checking process can be continued, which is not represented in detail here, and the vacuum for the basic value can again be lowered by one stage to the level G33. In this case the vacuum for the work demand remains at the level A32 which had been reached. If the number of occurring errors as the result of decreasing the vacuum for the basic demand should not increase during the renewed decrease in the subsequent time period, it can be assumed that the vacuum now obtained can be considered to be optimal for the basic demand.

This decreasing cycle of vacuum operation can be repeated, if the corresponding time periods are matched to the batch length and the time periods are such that the number of occurring errors could give sufficient information regarding the effects of the reductions of the vacuum. By repeating a decreasing vacuum cycle, it is possible to check whether the optimal value determined in the first cycle for the vacuum for the basic demand or the work demand has been verified.

Figure 4:
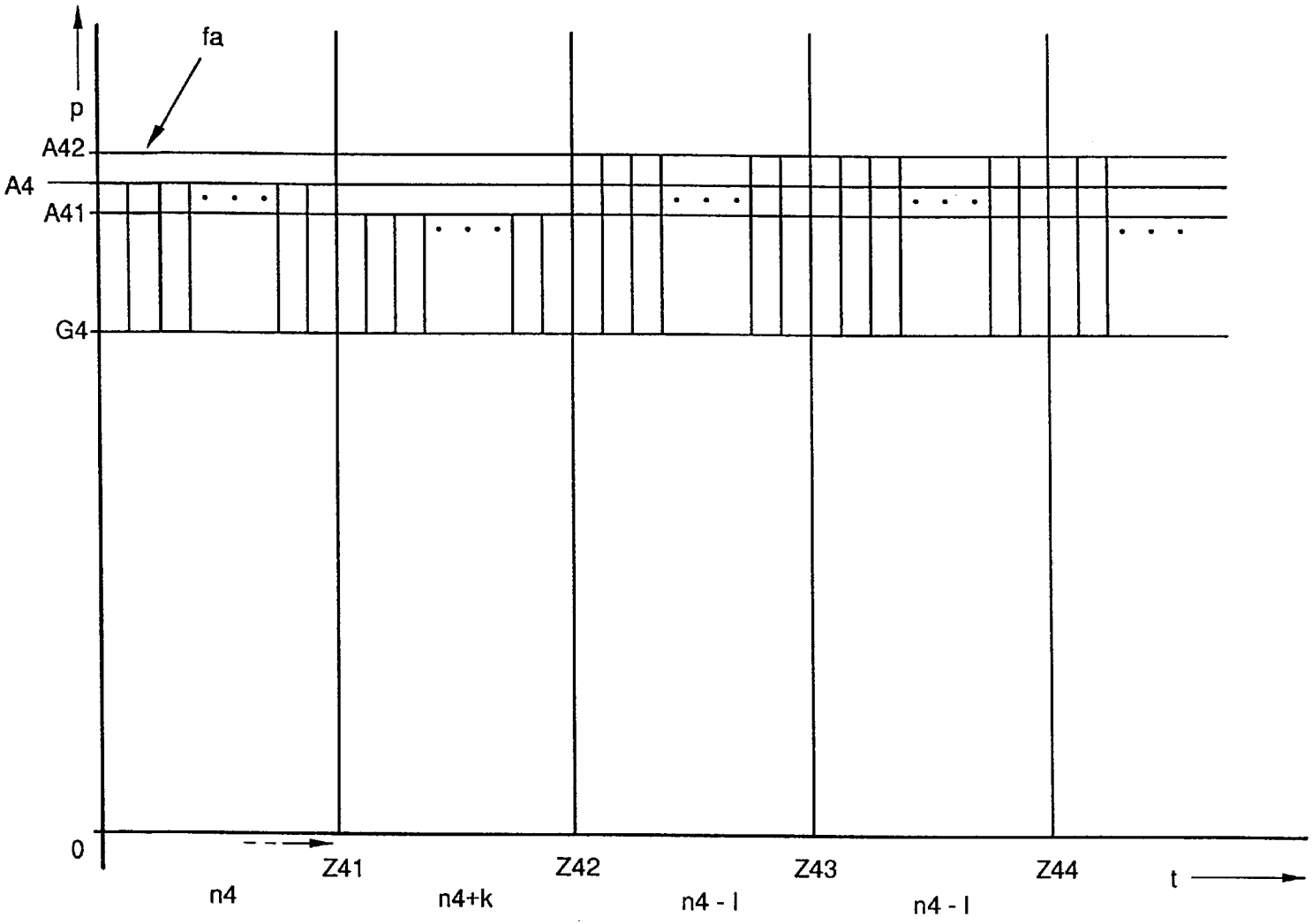
FIG. 4 is a pressure-time flow diagram representing an increase of the vacuum for the work demand above the set value, in accordance with the present invention.

A pressure-time diagram is schematically presented in FIG. 4, wherein initially the vacuum for the work demand set at the start of the batch is reduced by a predetermined amount after a predetermined time period Z41 from the level A4 to the level A41. The number n4+k of the errors fa which have occurred during the time period Z42 lies above the number n4 of the errors fa which have occurred in the first time period Z41 and above a threshold value. It can be deduced from this number of errors that the vacuum set at the batch start was not optimal. For this reason, at the start of the time period Z43, the vacuum for the work demand is raised by a predetermined amount to the level A42, which lies above the work pressure A4 set at the start of the batch. It is thereby intended to determine whether the initially set vacuum was optimal at all. During the time period Z43 the number of occurring errors is reduced by 1 in comparison to the number of errors which had occurred during the first time period Z41 after the batch start. By increasing the vacuum for the work demand to the level A42, the number of occurring errors is advantageously reduced. In the subsequent time period Z44, in which the vacuum is maintained at the level A42, the number of errors drops below the number of errors which had occurred in the time period 41 in which the originally set vacuum prevailed, so that the vacuum at the level A42 can be considered to be optimal.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for regulating the vacuum in a suction air installation comprising a suction unit at a textile machine with a plurality of work stations which make various demands on suction air, the method comprising the steps of regulating the vacuum output of the suction unit to prevent the vacuum output from dropping below a basic level which satisfies basic demands of the machine for the vacuum output and to increase the vacuum output by a predeterminable amount in response to work occurrences of the machine which impose additional work demands of the machine for the vacuum output, said regulating comprising optimizing the vacuum output for a new textile batch by starting the batch with a first predetermined vacuum setting selected to satisfy the basic demands and a second predetermined vacuum setting selected to satisfy the work demands, during a first predetermined time period in the course of the batch counting errors which cannot be rectified and the attempts to rectify errors caused by insufficient vacuum, subsequently increasing or decreasing at least one of the first and second vacuum settings, during a second subsequent predetermined time period in the course of the batch counting errors which cannot be rectified and the attempts to rectify errors caused by insufficient vacuum, comparing the number of errors counted during the second time period with the number of errors counted in the first time period to identify an increase or a decrease in the number of errors, if an increase or a decrease in the number of counted errors exceeds a maximum predetermined number of errors then subsequently selecting the greater vacuum setting utilized for the at least one vacuum setting during the first and second predetermined time periods, and if no change in the number of errors is identified or if an increase or a decrease in the number of counted errors is less than the maximum predetermined number of errors then subsequently selecting the lower vacuum setting utilized for the at least one vacuum setting during the first and second predetermined time periods.

2. The method in accordance with claim 1, further comprising, during a third predetermined time period in the course of the batch following said second predetermined time period, counting errors which cannot be rectified and the attempts to rectify errors caused by insufficient vacuum, comparing the number of errors counted during the third time period with the number of errors counted during the second time period to identify an increase or a decrease in the number of errors, and, if no change in the number of counted errors is identified or if an increase or a decrease in the number of counted errors is less than the maximum predetermined number of errors then subsequently selecting the lower vacuum setting utilized for the at least one vacuum setting during the second and third predetermined time periods, and if an increase or a decrease in the number of counted errors is greater than the maximum predetermined number of errors then subsequently selecting the greater vacuum setting utilized for the at least one vacuum setting during the second and third predetermined time periods.

3. The method in accordance with claim 1, wherein the optimizing step comprises starting the new batch without experimental values regarding the number of errors to be expected in connection with the batch, and reducing the vacuum output after the first and successive time periods until the maximum predetermined number of errors is exceeded and thereafter increasing the vacuum output at least to the preceding level.

4. The method in accordance with claim 1, wherein the optimizing step comprises starting the new batch with experimental values regarding the number of errors to be expected in connection with the batch, and after the first time period, reducing the vacuum output if the maximum predetermined number of errors is not exceeded and increasing the vacuum output if the maximum predetermined number of errors is exceeded.

5. The method in accordance with claim 1, further comprising storing the value of the lowest vacuum output at which the predetermined number of errors is not exceeded as an optimized vacuum value for the batch.

6. The method in accordance with claim 1, wherein the starting step comprises automatically presetting a stored optimal value for the vacuum output.

7. The method in accordance with claim 1, wherein the length of the time periods is matched to a batch running time and to parameters of the textile material.

8. The method in accordance with claim 1, wherein the predetermined vacuum settings for the basic and for the work demand are selected to have a defined relation to one another.

9. The method in accordance with claim 8, wherein the increasing or decreasing step comprises increasing or decreasing both the first and the second vacuum settings in a predetermined relationship to each other.

10. The method in accordance with claim 1, wherein the increasing or decreasing step comprises decreasing at least one vacuum setting for the second time period, and increasing the at least one vacuum setting during the second time period if the number of errors during the second time period exceeds the predetermined number of errors prior to the end of the second predetermined time period.

11. The method in accordance with claim 1, further comprising repeating the counting and the increasing or decreasing steps for a third predetermined time period following said second time period for verifying the vacuum output values utilized during said second time period.

12. A method for regulating the vacuum in a suction air installation comprising a suction unit at a textile machine with a plurality of work stations which make various demands on suction air, the method comprising the steps of regulating the vacuum output of the suction unit to prevent the vacuum output from dropping below a basic level which satisfies basic demands of the machine for the vacuum output and to increase the vacuum output by a predeterminable amount in response to work occurrences of the machine which impose additional work demands of the machine for the vacuum output, said regulating comprising optimizing the vacuum output for a new textile batch by starting the batch with a first predetermined vacuum setting selected to satisfy the basic demands and a second predetermined vacuum setting selected to satisfy the work demands, during a first predetermined time period in the course of the batch counting errors which cannot be rectified and the attempts to rectify errors caused by insufficient vacuum, and during a second subsequent predetermined time period in the course of the batch, increasing at least one of the first and second vacuum settings if the number of counted errors exceeds a maximum predetermined number of errors and decreasing the at least one vacuum setting if the number of counted errors is less than the maximum predetermined number of errors.

13. The method in accordance with claim 12, further comprising, during the second predetermined time period in the course of the batch, counting errors which cannot be rectified and the attempts to rectify errors caused by insufficient vacuum, during a third predetermined time period in the course of the batch following the second time period increasing the at least one vacuum setting if the number of counted errors during the second time period exceeds the maximum predetermined number of errors and decreasing the at least one vacuum setting if the number of counted errors during the second time period is less than the maximum predetermined number of errors.

14. The method in accordance with claim 12, wherein the optimizing step comprises starting the new batch without experimental values regarding the number of errors to be expected in connection with the batch, and reducing the vacuum output after the first and successive time periods until the maximum predetermined number of errors is exceeded and thereafter increasing the vacuum output at least to the preceding level.

15. The method in accordance with claim 12, wherein the optimizing step comprises starting the new batch with experimental values regarding the number of errors to be expected in connection with the batch, and after the first time period, reducing the vacuum output if the maximum predetermined number of errors is not exceeded and increasing the vacuum output if the maximum predetermined number of errors is exceeded.

16. The method in accordance with claim 12, further comprising storing the value of the lowest vacuum output at which the maximum predetermined number of errors is not exceeded as an optimized vacuum value for the batch.

17. The method in accordance with claim 12, wherein the starting step comprises automatically presetting a stored optimal value for the vacuum output.

18. The method in accordance with claim 12, wherein the length of the time periods is matched to a batch running time and to parameters of the textile material.

19. The method in accordance with claim 12, wherein the predetermined vacuum settings for the basic and for the work demand are selected to have a defined relation to one another.

20. The method in accordance with claim 19, wherein the increasing and decreasing steps comprise increasing or decreasing both the first and the second vacuum settings in a predetermined relationship to each other.

21. The method in accordance with claim 12, and further comprising, if the decreasing step is performed for the second time period, increasing the at least one vacuum setting during the second time period if the number of errors during the second time period exceeds the predetermined number of errors prior to the end of the second predetermined time period.

22. The method in accordance with claim 12, further comprising repeating the counting step during the second predetermined time period and repeating the increasing or decreasing steps for a third predetermined time period following said second time period for verifying the vacuum output values determined during said second time period.

23. A method for regulating the vacuum in a suction air installation comprising a suction unit at a textile machine with a plurality of work stations which make various demands on suction air, the method comprising the steps of regulating the vacuum output of the suction unit to prevent the vacuum output from dropping below a basic level which satisfies basic demands of the machine for the vacuum output and to increase the vacuum output by a predeterminable amount in response to work occurrences of the machine which impose additional work demands of the machine for the vacuum output, said regulating comprising optimizing the vacuum output for a new textile batch by starting the batch with a first predetermined vacuum setting selected to satisfy the basic demands and a second predetermined vacuum setting selected to satisfy the work demands, during a first predetermined time period in the course of the batch counting errors which cannot be rectified and the attempts to rectify errors caused by insufficient vacuum, subsequently increasing or decreasing at least one of the first and second vacuum settings during a second subsequent predetermined time period in the course of the batch counting errors which cannot be rectified and the attempts to rectify errors caused by insufficient vacuum, comparing the number of errors counted during the second time period with the number of errors counted in the first time period to identify an increase or a decrease in the number of errors, if an increase in the number of counted errors exceeds a maximum predetermined number of errors then subsequently selecting the greater vacuum setting utilized for the at least one vacuum setting during the first and second predetermined time periods, and if no change in the number of errors is identified or if an increase or a decrease in the number of counted errors is less than the maximum predetermined number of errors then subsequently selecting the lower vacuum setting utilized for the at least one vacuum setting during the first and second predetermined time periods.

24. The method in accordance with claim 23, further comprising, during a third predetermined time period in the course of the batch following said second predetermined time period, counting errors which cannot be rectified and the attempts to rectify errors caused by insufficient vacuum, comparing the number of errors counted during the third time period with the number of errors counted during the second time period to identify an increase or a decrease in the number of errors, and, if no change in the number of counted errors is identified or if an increase or a decrease in the number of counted errors is less than the maximum predetermined number of errors then subsequently selecting the lower vacuum setting utilized for the at least one vacuum setting during the second and third predetermined time periods, and if an increase in the number of counted errors is greater than the maximum predetermined number of errors then subsequently selecting the greater vacuum setting utilized for the at least one vacuum setting during the second and third predetermined time periods.

* * * * *